United States Patent [19]

Logan, Jr. et al.

[11] Patent Number: 4,466,208

[45] Date of Patent: Aug. 21, 1984

[54] EMERGENCY EXIT SIGN UTILIZING AN ELECTRO-LUMINESCENT (EL) LAMP AND A BRIGHTNESS MONITOR

[76] Inventors: Emanuel L. Logan, Jr., 2301 Jeff. Davis Hwy., Apt. 1024, Arlington, Va. 22202; J. William Walsh, 3823 Beech Ave., Baltimore, Md. 21211

[21] Appl. No.: 404,391

[22] Filed: Jul. 30, 1982

[51] Int. Cl.[3] ..... G09F 13/22

[52] U.S. Cl. ..... 40/544; 40/465; 40/570; 40/580

[58] Field of Search ..... 40/544, 580, 594, 570, 40/902, 442, 465, 562; 24/255 R; 361/173; 313/567; 339/66 R

[56] References Cited

U.S. PATENT DOCUMENTS

| | | | |
|---|---|---|---|
| 1,976,515 | 10/1934 | Randel | 339/66 R |
| 2,089,567 | 8/1937 | Moffat | 313/567 |
| 3,089,973 | 5/1963 | Herold et al. | 40/544 |
| 3,237,057 | 2/1966 | Adkins | 361/173 |
| 3,309,052 | 3/1967 | Borisof | 24/255 R |
| 3,680,237 | 8/1972 | Finnerty, Sr. | 40/544 |
| 4,016,450 | 4/1977 | Balekjian | 40/542 |

*Primary Examiner*—Robert Peshock
*Assistant Examiner*—Cary E. Stone
*Attorney, Agent, or Firm*—Quaintance & Murphy

[57] ABSTRACT

An emergency exit sign utilizes an EL lamp in combination with a pilot light which is connected to the EL lamp via a photoelectric link. The photoelectric link monitors the brightness of the EL lamp and keeps the pilot light on so long as the EL lamp is lit. The pilot light is necessary because the illumination provided by the EL lamp may be less than the illumination of background brightness making it difficult to tell by looking at the EL lamp whether or not the EL lamp is energized. Since the pilot light provides a "point" of illumination, it is easy to see when it is on so that one can tell whether or not the sign is lighted by simply looking at the pilot light.

In order to see the exit sign even if power to the EL lamp is interrupted and the room is dark, a translucent sheet of phosphorescent material is placed over the EL lamp to transmit light from the EL lamp while at the same time storing energy so as to "glow in the dark" should the EL lamp be extinguished.

In order to increase utilization of this exit sign, structure is provided for easily retrofitting the sign to existing emergency exit housings. The structure includes spring-closed, U-shaped clips which are frictionally attached to the housing and which each have an exposable adhesive surface against which the exit sign is pressed for permanently installing the sign on the housing. In addition, an adapter is provided which allows the exit sign to be readily plugged into the existing lightbulb socket prior to adhering the exit sign to the housing.

7 Claims, 8 Drawing Figures

EMERGENCY EXIT SIGN UTILIZING AN ELECTRO-LUMINESCENT (EL) LAMP AND A BRIGHTNESS MONITOR

RELATED PATENT APPLICATION

U.S. patent application Ser. No. 353,390, U.S. Pat. No. 4,420,878, filed Mar. 1, 1982, titled "Flat Emergency Exit Sign Utilizing An Electro-Luminescent Lamp."

BACKGROUND OF THE INVENTION

Almost all public buildings are required to have signs identifying emergency exits. These signs are generally rectangles and are perhaps twelve inches long and eight inches high. The dimensions may vary depending on the code or standard governing the size of the signs.

Most of these signs are illuminated by incandescent lamps. In order to illuminate the entire sign, two twenty-watt lamps are usually required. Most fire codes require that the signs be lit continuously while the building is occupied. Since many public buildings have numerous exits, a single building may have hundreds of signs, consuming thousands of kilowatts of electricity per year. In addition, the signs generate heat which must be removed during the air conditioning season. Since the signs are located near ceilings, the heat input during the heating season is minimized because much of the heat is conducted and convected along the floors to the exterior walls of the building. Moreover, at least one of the emergency exit light bulbs can be expected to burn out during the course of the year. When a building has hundreds of emergency exit signs, the cost of replacing these bulbs can be quite high. It has been estimated that each emergency exit sign costs between $70 and $120 per year to operate and maintain.

The electro-luminescent emergency exit sign disclosed in U.S. patent application Ser. No. 353,390 may have the disadvantage of not appearing to be on or lit if background lighting is at a certain level. In other words, the regular lighting in the room or hallway containing the emergency exit sign may appear brighter than the light emitted by the emergency exit sign itself. Consequently, the fact that the sign is energized may not be apparent to an observer, even though once the background lighting is extinguished or substantially diminished, the electro-luminescent sign appears lit. Fire inspectors are used to seeing emergency exit signs in which incandescent bulbs emit illumination from a small area which illumination is bright enough to be seen above the ambient or regular room illumination. When the fire inspector does not see light being emitted from the sign, he assumes that the sign is out and that it will not be visible in the dark. Accordingly, if the concept set forth in U.S. patent application Ser. No. 353,390 is to be acceptable to many fire inspectors, the fire inspectors need an indication that the exit signs utilizing electro-luminescent lamps are energized so that they will be visible in the dark. This is especially the case with exit signs utilizing electro-luminescent panels having extremely low wattages. For example, this is a problem with the electro-luminescent panels manufactured by the Potter Electronics Company of Charlotte, N. C., which successfully illuminate emergency exit signs in darkened rooms with a power consumption of less than one watt.

The light output of electro-luminescent lamps tends to degrade with time. After years of service, a lamp may become so dim that the sign it lights is not readily visible in a darkened room. Consequently, there is a need for a monitor which informs maintenance people that the lamp needs replacement or servicing. With emergency exit signs using incandescent lamps, it is readily apparent that a lamp is on or off simply because one can readily see if a twenty-five watt incandescent lamp is either lit or unlit above regular or ambient lighting.

If emergency exit signs utilizing the principles set forth in U.S. patent application Ser. No. 353,390 are to be widely adopted, it is necessary that such signs be configured for convenient retrofitting to existing exit sign housings so as to minimize the difficulties for those who wish to take advantage of the energy and maintenance savings inherent in such signs.

SUMMARY OF THE INVENTION

In view of the aforementioned considerations, it is a feature of the instant invention to provide a new and improved emergency exit sign which is inexpensive to purchase, operate and maintain, and which has a relatively long life. In addition, it is a feature of the instant invention to provide a new and improved emergency exit sign which includes an indicator that tells whether the sign is lit or extinguished when illumination from an EL lamp used with the sign is not bright enough to surpass background illumination.

In view of the aforementioned feature, the instant invention contemplates an emergency exit sign which includes a flat electro-luminescent EL lamp and a stencil defining the word "EXIT" or a facsimile of the word "EXIT" disposed over the lamp. The exit sign further includes a phosphorescent material associated with the word "EXIT" which remains lit even if the EL lamp is extinguished whereby the sign is visible when power to the EL lamp is cut. Moreover, the emergency exit sign includes a pilot light which remains lit as long as the lamp is lit. When the lamp is not energized, the pilot light, which is connected by a photo-electric link to the lamp, is extinguished.

The instant invention further contemplates a photo-electric link between the pilot light and EL lamp wherein the pilot light extinguishes when the illumination from the lamp drops beneath a predetermined level.

The instant invention further contemplates an emergency exit lamp wherein the lamp has mounting structure readily suitable for retrofit applications.

DESCRIPTION OF THE PREFERRED EMBODIMENT

Figure 1:
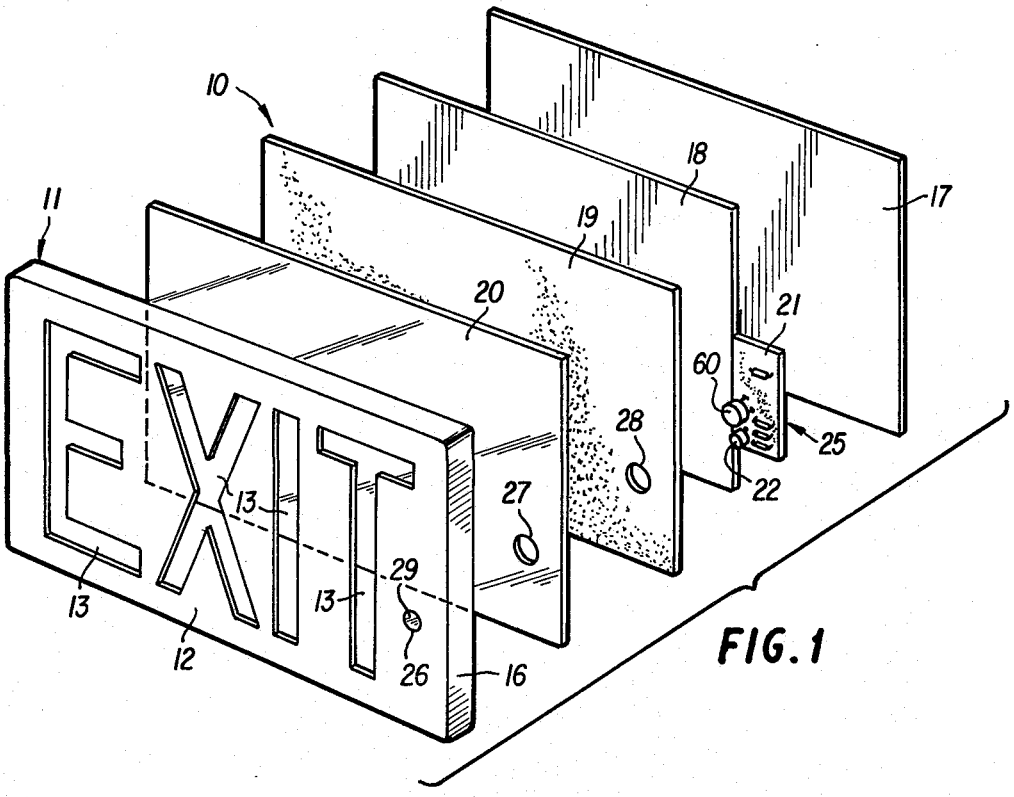
FIG. 1 is an exploded, perspective view of an emergency exit sign in accordance with the instant invention.
Figure 2:
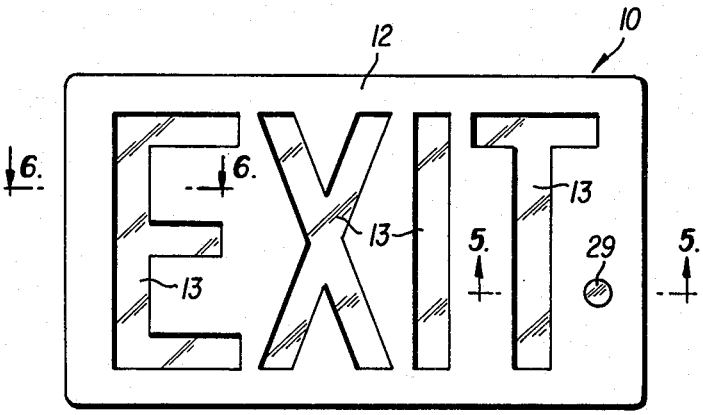
FIG. 2 is a front view of an emergency exit sign in accordance with the instant invention.

Referring now to FIG. 1, there is shown an emergency exit sign assembly, designated generally by the numeral 10,which includes a housing, designated generally by the numeral 11, which has a front face 12 that is cut out at locations 13 to make a stencil forming the word "EXIT". The housing 11 is preferably made of thermoformed plastic and includes side flanges 16. The side flanges 16 cooperate with a thermoformed back panel 17 to form an enclosure which contains an EL light source panel or lamp 18; a translucent, phosphorescent sheet 19, and a transparent protective plastic sheet 20. Mounted beside the EL panel 18 is a circuit board 21 which includes a neon pilot lamp 22 and circuitry, designated generally by the numeral 25, for driving the neon lamp. The neon lamp 22 is visible through the front face 12 of the housing 11 via an opening 26 that is aligned with openings 27 and 28 in the protective plastic sheet 20 and translucent phosphorescent sheet 19, respectively. A transparent lens 29 is seated in the opening 26 to protect the bulb 22.

Figure 3:
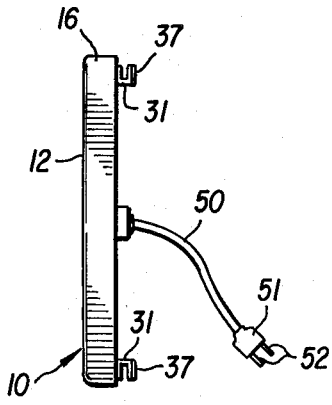
FIG. 3 is a side view of an emergency exit sign in accordance with the instant invention.
Figure 4:
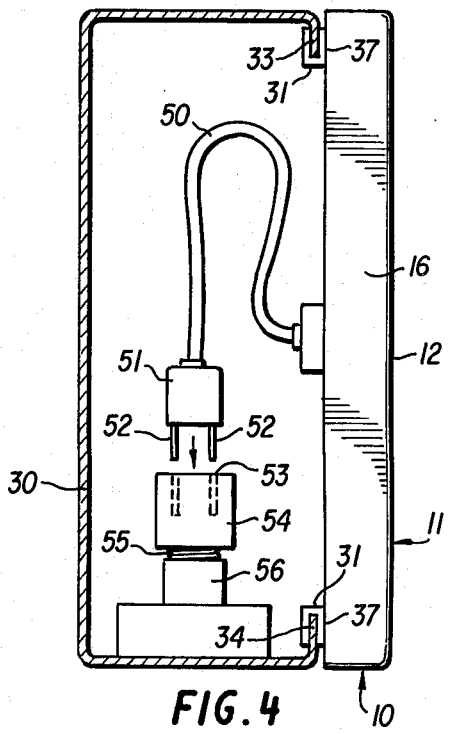
FIG. 4 is a side sectional view showing the emergency exit sign mounted on an existing exit sign support housing.

Referring now to FIGS. 3 and 4, in accordance with one embodiment of the invention, the entire exit sign assembly 10 is configured for retrofit installation on an existing emergency exit sign housing 30. In accordance with one approach, the exit sign assembly 10 is mounted with upper and lower mounting clips, designated generally by the numeral 31. The mounting clips 31 are U-shaped in cross section and simply fit over upper and lower flanges 33 and 34 on the housing 30 in order to secure the exit sign assembly 10 to the housing.

Figure 8:
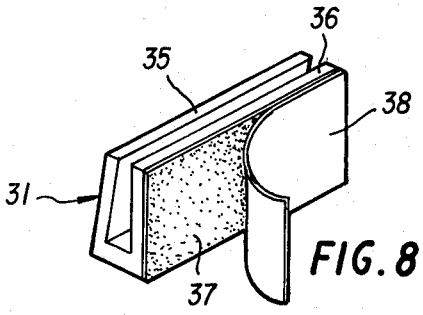
FIG. 8 is a perspective view of a single mounting clip.

Preferably, the clips 31 are similar to the clips shown in FIG. 8 and similar to clips manufactured by Richo Plastics, which clips are normally used for holding flat cable in place. The clips 31 have legs 35 and 36 which are normally spring-shut so that they will grip the flanges 33 and 34 on the housing 30. On each of the legs 36 of the clips 31, there is an adhesive surface 37 which is exposed by peeling a backing 38 off a double adhesive foam core. The rear surface of the back panel 17 is simply pressed against the exposed adhesive surface 37 in order to mount exit sign assembly 10 on the housing 30. The U-shaped clips 31 are preferably one inch to three inches in length.

By utilizing clips such as the clips 31 which are initially separate and apart from the housing 30 and the exit light assembly 10, the assembly 10 can be conveniently retrofitted to an existing housing 30, regardless of the size of the opening defined by the flanges 33 and 34.

In order to energize the electro-luminescent lamp 18 when mounted as a retrofit, the lamp is connected by line 50 to a plug 51 having prongs 52 that are received in the female end 53 of an adapter 54. The adapter 54 has a threaded end 55 which screws into an existing lightbulb socket 56. Normally, the light-bulb socket 56 is of a candelabra size, so that the adapter 54 needs a threaded end 55 sized accordingly.

In mounting the exit sign assembly 10 on a housing 30, the following steps are taken. First, the existing lightbulbs are removed from the sockets 56. (Normally there are two lightbulbs.) The adapter 54 is screwed into one of the sockets 56. The clips 31 are mounted on the flanges 33 and 34. The plug 51 is plugged into the adapter 54. The protective tape 38 is peeled from the clips 31 to expose the adhesive backing 37. The exit sign assembly 10 is aligned with the housing 30 and pressed home against the exposed adhesive 37.

Figure 7:
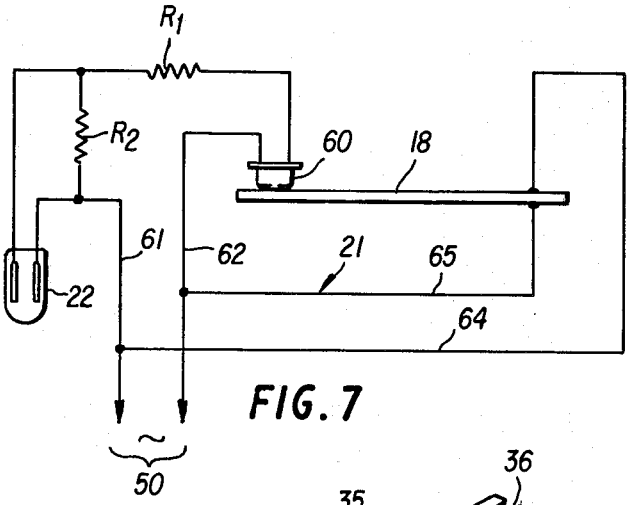
FIG. 7 is a circuit diagram showing the configuration of a pilot light circuit utilized with the instant invention.
Figure 5:
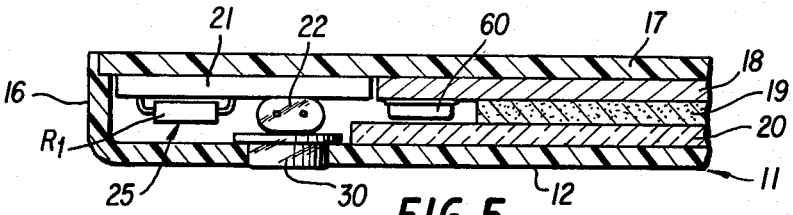
FIG. 5 is an enlarged sectional view taken along lines 5—5 of FIG. 2 showing various electrical components.
Figure 6:
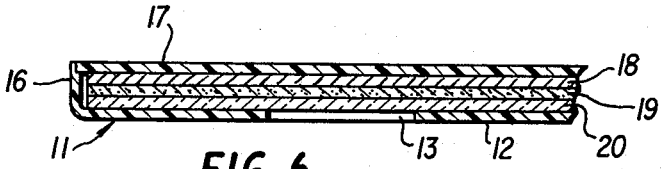
FIG. 6 is an enlarged sectional view taken along lines 6—6 of FIG. 2.

Referring now more specifically to FIGS. 5 and 7, a photocell 60 is mounted adjacent to the EL lamp 18 to sense the illumination generated by the lamp. The photocell 60 is connected in series with the neon lamp 22 and serves as a switch to maintain current flowing to the lamp as long as the illumination from the panel 18 is above a predetermined level. For example, a level of 1.6 foot lamberts may be considered sufficient. When the illumination from the lamp 18 drops below the predetermined level, the photocell 60 turns off and no longer transmits current to the neon pilot light 22. The pilot light 22 receives current from leads 61 and 62 which are contained within the power line 50 and which provide 60-cycle alternating line current to the electro-luminescent panel 18 via lines 64 and 65. Resistors R1 and R2 control the amount of current flowing to the neon light 22 from lines 61 and 62.

In accordance with one embodiment of the invention, the following electrical components are utilized with 60 hz, 120 volt input current on line 50:

EL lamp 18—phosphors encapsulated on steel substrate by glass-manufactured by Potter Electronics, Yancyville, N.C.

Neon lamp 22 NE-2 neon lamp

Photocell 60—Clairex CL705L, cadium sulfide photocell

Resistor R1—15KΩ, ¼ watt

Resistor R2 68KΩ, ¼ watt.

The translucent phosphorescent sheet 19 stores light energy emitted by the EL lamp 18 as well as ambient light energy while allowing light from the EL lamp to pass therethrough and out of the stencil opening 13. If there is a power failure in the building which cuts off the electrical lights and also cuts power to the exit sign assembly 10, the phosphorescent panel 19 will still emit light through the stencil 13 so that the word "EXIT" can be seen in the dark.

In summary, the instant invention provides an energy-efficient exit sign which utilizes an electro-luminescent (EL) light source or lamp 18 as a primary light source for the exit sign assembly 10 and a phosphorescent light source 19 as a secondary light source should power to the exit sign assembly be interrupted. The monitoring circuit 25 indicates whether there is adequate luminescence of the electro-luminescent lamp 18 and indicates the presence of electrical power to illuminate the sign if the sign is not readily visible in ambient light. Moreover, a technique for mounting the exit sign assembly 10 is provided by the clips 31 which allow the assembly 10 to be retrofitted on existing housings of various configurations.

Since the electro-luminescent lamp 18 and the neon pilot light 22 together consume less than 1 watt of electricity and since the lamps 18 have a life expectancy of ten years, there is approximately a 99% reduction in operating costs compared to conventional incandescent fixtures. Since the EL lamp 18 cannot be easily broken due to its rugged construction, maintenance costs due to vandalism can be greatly reduced.

The foregoing embodiments and examples are merely illustrative of the instant invention which is to be limited only by the following claims.

What is claimed is:

1. An emergency exit sign comprising:

an EL light source; wherein the DL light source inclddes a layer of phosphorous encapsulated between a layer of glass and a steel substrate;

means for energizing the EL light source;

means for configuring the light emitted by the EL light source into a message meaning "exit";

photoelectric cell means disposed adjacent the EL light source for monitoring the intensity of the illumination emitted by the EL light source;

a pilot ligh for indicating that the EL light source is illuminating, and means for connecting the photoelectric cell means to the pilot light for allowing current to flow to the pilot light only when the photoelectric cell means detects illumination of the EL light source, whereby the pilot light will indicate that the EL light source is energized and working even when background illumination is greater than the illumination from the EL light source.

2. The emergency exit bign of claim 1 further including retrofit means for mounting the exit sign on an existing exit sign housing which includes upper and lower flanges behind which an existing emergency exit sign is held, and wherein the retrofit means includes U-shaped clips having legs which are spring-biased toward one another, wherein the U-shaped clips are slipped over the flanges with the flanges between the legs of the clips so that the clips are frictionally secured to the flanges;

an outwardly-facing adhesive surface on at least one of the legs of each clip, and a casing enclosing the retrofit sign with the casing having a rigid back portion wherein when the sign is pressed against the adhesive, a rigid structure results locking the retrofit sign to the housing.

3. The retrofit device of claim 2 further including a plug electrically connected by a flexible line to the EL light source, and an adapter having a socket at one end for receiving the plug and screw threads at the other end for screwing into an existing light bulb socket once the light bulb has been removed.

4. The emergency exit sign of claim 1 wherein the photoelectric cell means is connected in series with the pilot light and in parallel with the lines which energize the EL light source.

5. The emergency exit sign of claim 4 wherein the pilot light is a neon lamp.

6. The emergency exit sign of claim 5 wherein resistance means is placed between the photoelectric cell means and pilot light to set a predetermined level at which the photocell switches off the neon lamp.

7. The emergency exit sign of claim 1, 4, 5 or 6 further including means for retrofitting the sign to existing emergency exit sign housings.

* * * * *